US008133662B2

(12) United States Patent
Watanabe et al.

(10) Patent No.: US 8,133,662 B2
(45) Date of Patent: Mar. 13, 2012

(54) METHOD FOR MANUFACTURING LIQUID DISCHARGE HEAD

(75) Inventors: Makoto Watanabe, Yokohama (JP); Yoshinori Tagawa, Yokohama (JP); Satoshi Ibe, Yokohama (JP); Kazuhiro Asai, Kawasaki (JP); Masaki Ohsumi, Yokosuka (JP); Masataka Nagai, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 216 days.

(21) Appl. No.: 12/721,415

(22) Filed: Mar. 10, 2010

(65) Prior Publication Data

US 2010/0233630 A1 Sep. 16, 2010

(30) Foreign Application Priority Data

Mar. 13, 2009 (JP) ..... 2009-060683

(51) Int. Cl.
*B41J 2/16* (2006.01)

(52) U.S. Cl. ..... 430/320; 430/323

(58) Field of Classification Search ..... None
See application file for complete search history.

(56) References Cited

U.S. PATENT DOCUMENTS 6,310,641 B1 * 10/2001 Mrvos et al. ..... 347/47
2006/0284933 A1 * 12/2006 Hatta ..... 347/56
2007/0099121 A1 5/2007 Kubota
2009/0291398 A1 * 11/2009 Horiuchi ..... 430/320
2010/0255424 A1 * 10/2010 Shiba et al. ..... 430/319

FOREIGN PATENT DOCUMENTS

JP 2006-315310 A 11/2006
JP 2007-007981 A 1/2007

* cited by examiner

*Primary Examiner* — John A. McPherson
(74) *Attorney, Agent, or Firm* — Canon U.S.A., Inc., IP Division

(57) ABSTRACT

A method for manufacturing a liquid discharge head that includes a flow path wall member which forms a wall of a flow path communicating with a discharge port for discharging a liquid and a substrate which forms the flow path in contact with the flow path wall member includes providing a first layer, which is made of a photosensitive resin on the substrate, for forming a pattern having a shape of the flow path, providing a second layer which is capable of absorbing light within a photosensitive wavelength range of the photosensitive resin and has a shape corresponding to the shape of the flow path, on the first layer so as to come into contact with the first layer, performing patterning of the first layer which includes exposure of the first layer with the light using the second layer as a mask, and forming the pattern from the first layer, providing a cover layer which is made of a photosensitive resin and serves as the flow path wall member so as to cover the second layer and the pattern, forming the discharge port on the cover layer by performing patterning of the cover layer which includes exposure of the cover layer with the light, and forming the flow path by removing the second layer and the pattern.

7 Claims, 5 Drawing Sheets

METHOD FOR MANUFACTURING LIQUID DISCHARGE HEAD

BACKGROUND OF THE INVENTION

1. Field of the Invention

The present invention relates to a method for manufacturing a liquid discharge head for discharging a liquid, and more particularly, to a method for manufacturing an ink jet recording head for performing recording by discharging ink to a recording medium.

2. Description of the Related Art

An ink jet recording head employed in an ink jet recording system is an example of a liquid discharge head used for discharging a liquid. The ink jet recording system discharges ink to a recording medium and performs recording. The ink jet recording head includes an ink flow path, a discharge energy generation unit provided at apart of the ink flow path, and a minute ink discharge port (it is referred to as an orifice) for discharging ink by generated energy.

U.S. Patent Publication No. 2007/0099121 discusses a method for manufacturing such a liquid discharge head. In the method, a pattern layer, which is a mold for a flow path, is formed on a substrate using a photosensitive material. The substrate includes a discharge energy generation unit. A flow path wall member is provided on the pattern layer, and then a space to become the flow path is formed by removing the pattern layer.

For the above described pattern which becomes the mold of the flow path, a positive photosensitive resin is used, and a photolithography method is used for patterning of the positive photosensitive resin. In exposing the positive photosensitive resin, an exposure apparatus that collectively exposes an entire substrate at a magnification of 1:1 is used due to a necessary amount of exposure.

However, the method for manufacturing a liquid discharge head discussed in U.S. Patent Publication No. 2007/0099121 has the following problems.

Since an exposure apparatus collectively exposes a large object (a positive photosensitive resin) provided on a substrate, positioning accuracy between the object and a mask used for exposing is insufficient. Particularly, when the exposure apparatus exposes the object on a large wafer which is about 8 to 12 inches, a warp or flexure of the substrate or the mask affects the positioning. Thus, the alignment accuracy between the mask and the object varies in the same substrate or varies for every substrate to be exposed.

Generally, a main chain decomposition type resin is used as the positive photosensitive resin. However, the main chain decomposition type positive photosensitive resin mostly has low sensitivity to ultraviolet light, so that the exposure apparatus needs to emit a large amount of energy to generate an enough decomposition reaction. Therefore, non-uniform heat expansion is caused between the mask and the substrate by the heat generation during an exposure operation, and resolution and alignment accuracy thus could be decreased. As a result, position deviation between the energy generating unit and the pattern that becomes the flow path occurs, and the pattern of the flow path may not be formed at a desired position of the substrate.

On the other hand, inventors found out in examination that the method described in U.S. Patent Publication No. 2007/0099121 may not form a discharge port having a desired shape when the discharge port is formed at the flow path wall member by using i-line light. The light used for the exposure reaches the substrate, is reflected on the substrate surface, passes through the pattern of the mold of the flow path, and then reaches the resin of the flow path wall configuring member. It was found out that a shape of the discharge port is varied from a desired one affected by such a path of the light.

SUMMARY OF THE INVENTION

The present invention is directed to a method for manufacturing a liquid discharge head which can accurately form a pattern of a mold of a flow path on a desired position of a substrate, and can accurately acquire a desired shape of a discharge port.

According to an aspect of the present invention, a method for manufacturing a liquid discharge head that includes a flow path wall member which forms a wall of a flow path communicating with a discharge port for discharging a liquid and a substrate which forms the flow path in contact with the flow path wall member includes providing a first layer, which is made of a photosensitive resin on the substrate, for forming a pattern having a shape of the flow path, providing a second layer which is capable of absorbing light within a photosensitive wavelength range of the photosensitive resin and has a shape corresponding to the shape of the flow path, on the first layer so as to come into contact with the first layer, performing patterning of the first layer which includes exposure of the first layer with the light using the second layer as a mask, and forming the pattern from the first layer, providing a cover layer which is made of a photosensitive resin and serves as the flow path wall member so as to cover the second layer and the pattern, forming the discharge port on the cover layer by performing patterning of the cover layer which includes exposure of the cover layer with the light, and forming the flow path by removing the second layer and the pattern.

According to an exemplary embodiment of the present invention, the method for manufacturing the liquid discharge head can control a position relationship among an energy generating unit, an ink flow path, and a discharge port on a substrate with high accuracy and high reproducibility, and can reproducibly produce a liquid discharge head which has excellent printing characteristic.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Figure 1:
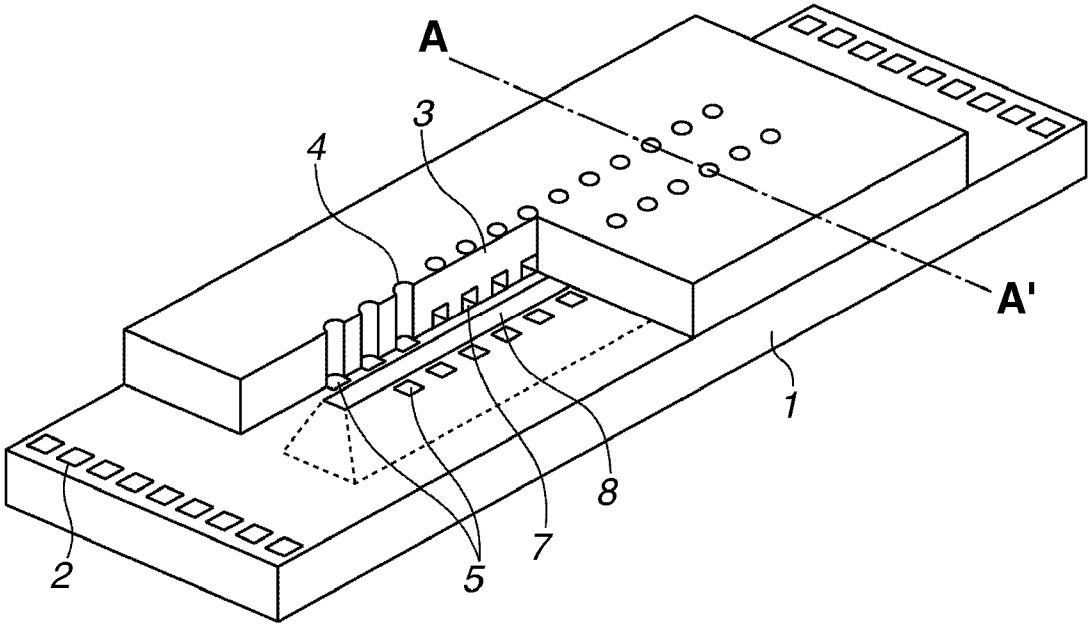
FIG. 1 is a schematic perspective view illustrating a liquid discharge head according to an exemplary embodiment of the present invention.

Various exemplary embodiments, features, and aspects of the invention will be described in detail below with reference to the drawings.

In the following descriptions, configurations which have same functions are denoted by the same reference numerals in the drawings, and description thereof may be omitted.

A liquid discharge head can be applied to an ink jet recording head used in an ink jet recording system. However, an applicable scope of the present invention is not limited to the ink jet recording head. The present invention can be applied to biochip manufacturing and electronic circuit printing.

The liquid discharge head can be installed in a printer, a copying machine, a facsimile including a communication system, a device such as a word processor including a printing unit, and an industrial recording apparatus in which various kinds of processing devices are complexly combined. For example, the liquid discharge head can be used for biochip manufacturing, electronic circuit printing, and discharging chemicals in an atomized state.

For example, the liquid discharge head can be used in recording to various kinds of recording mediums, such as paper, threads, fibers, cloth, leather, metals, plastics, glass, wood, and ceramics. In the description of the present invention, "recording" means not only for providing an image with meaning such as characters or graphics to a recording medium but also for providing an image without meaning such as a pattern to the recording medium.

An exemplary embodiment of a liquid discharge head of the present invention will be described below.

FIG. 1 is a schematic view illustrating a liquid discharge head according to an exemplary embodiment of the present invention.

The liquid discharge head according to the exemplary embodiment of the present invention includes a substrate 1 on which energy generating elements 5 are formed at predetermined pitches. The energy generating element 5 generates energy for discharging a liquid. On the substrate 1, a supply port 8 for supplying ink has its opening between two rows of the energy generating elements 5. On the substrate 1, discharge ports 4 and individual ink flow paths 7 are formed. The discharge ports 4 open above each of the energy generating elements 5. The ink flow paths 7 communicate with each of the discharge ports 4 from the supply port 8.

A discharge port member 3 functions as a flow path wall member which forms a wall of the individual flow paths 7 communicating with each of the discharge ports 4 from the supply port 8. The flow path wall member can be separately provided from the discharge port member 3. A position of the discharge port 4 is not limited to a position facing to the energy generating element 5.

The liquid discharge head is disposed such that a surface on which the discharge ports 4 are formed faces a recording surface of a recording medium. Energy generated by the energy generating elements 5 is applied to a liquid filled in the flow path via the supply port 8 to discharge droplets of the liquid from the discharge port 4, so that recording is performed by adhering the discharged droplets on the recording medium. An energy generating element can include an electrothermal transducer (a heater) for generating thermal energy and a piezoelectric element for generating mechanical energy, but is not limited to them. Then, a feature of a configuration of a recording head according to the present invention will be described in detail below with reference to FIGS. 2A and 2B.

Figure 2A:
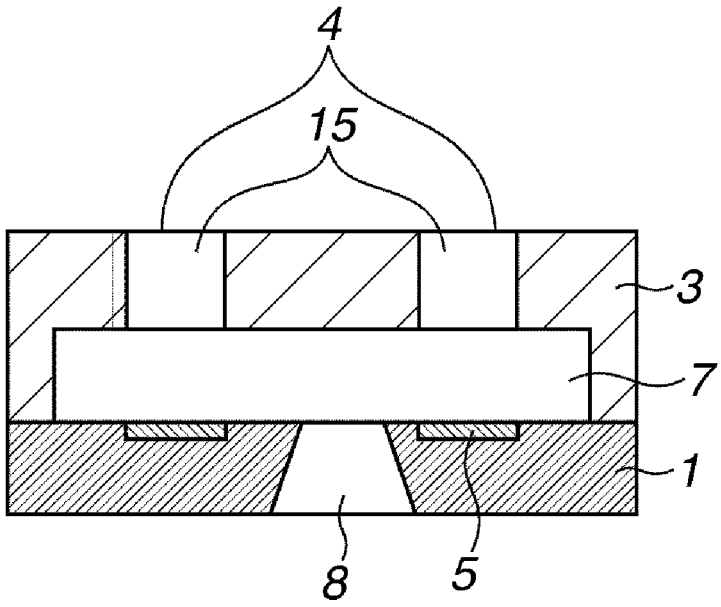
FIGS. 2A and 2B are schematic cross-sectional views of a liquid discharge head according to the exemplary embodiment of the present invention.
Figure 2B:
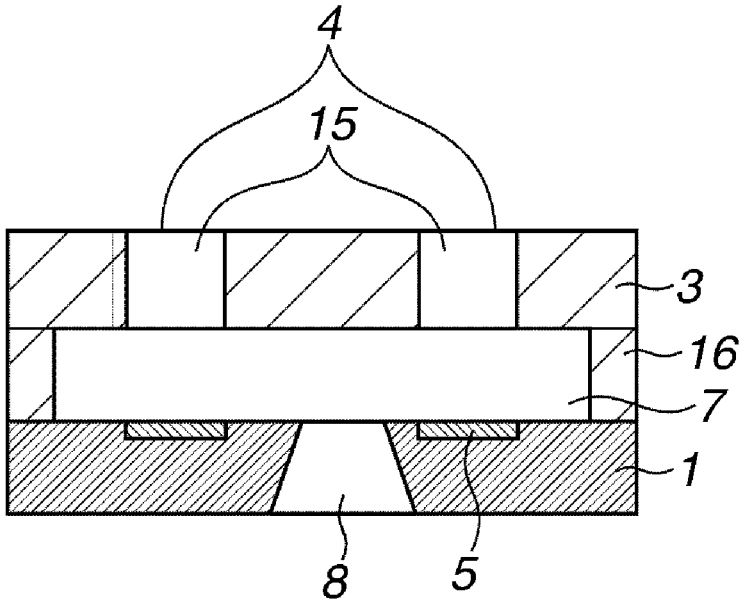

FIGS. 2A and 2B are schematic cross-sectional views of the recording head according to the exemplary embodiment of the present invention. The cross-sectional view is a surface vertical to the substrate that is taken along a line A-A' in FIG. 1.

As illustrated in FIG. 2A, in the discharge port member 3, an opening portion on the surface is denoted as the discharge port 4, and a portion communicating a flow path 7 and the discharge port 4 is denoted as a discharge portion 15 to differentiate from each other. The discharge portion 15 can have a tapered shape whose cross section area parallel to the substrate 1 gradually decreases from the substrate side to the discharge port 4.

As illustrated in FIG. 2B, the liquid discharge head can include a flow path wall member 16 between the discharge port member 3 and the substrate 1. The flow path wall member 16 configures a side wall of the flow path 7.

A method for manufacturing the liquid discharge head according to the present invention will be described below with reference to FIGS. 3A to 3I and FIGS. 5A to 5E. FIGS. 3A to 3I and FIGS. 5A to 5E are cross-sectional views that are similar to that in FIG. 2A.

Figure 3A:
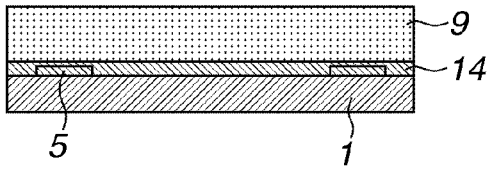
FIGS. 3A to 3I are schematic cross-sectional views illustrating an example of a production method a liquid discharge head according to the exemplary embodiment of the present invention.

As illustrated in FIG. 3A, a substance in which a first layer 9 made of a photosensitive resin is formed on the substrate 1 is prepared. The substrate 1 includes a heater 5 and a silicon nitride (SiN) membranous layer 14 for protecting the heater 5 on the surface thereof. The heater 5 serves as an energy generating element for generating energy used for discharging a liquid. The first layer 9 occupies an area to be a flow path and a liquid chamber which is a part of the flow path, and forms a pattern having a shape of the flow path.

A positive photosensitive resin is suitable for a photosensitive resin for forming the first layer 9. As for the positive photosensitive resin, polymethyl isopropenyl ketone (PMIPK) dissolved in cyclohexanone can be used. Further, a positive resist produced by dissolving polymethyl methacrylate (PMMA) in diethyleneglycol dimethylether can be used. The first layer 9 is formed 5.0 μm to 15.0 μm thick by a coating method, such as a spin coating method, a roll coating method, or a slit coating method.

Figure 3B:
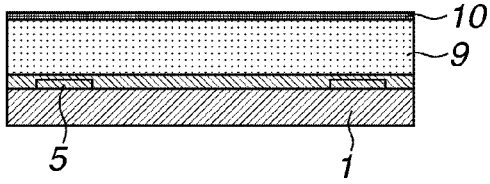

Then, as illustrated in FIG. 3B, a material layer is formed on the first layer 9 on the substrate. The material layer forms a second layer 10*a* which has a shape corresponding to the shape of the flow path. The material layer serves a mask when the first layer 9 is subjected to patterning. Thus, the material layer is formed with a material which can absorb light within a photosensitive wavelength range of the first layer 9.

The material layer is required to absorb a wavelength to which the first layer 9 is sensitive and becomes positive, among exposure wavelength of the first layer 9. Further, the material layer is required to absorb light within a photosensitive wavelength range of a cover layer, which is described below. As such a material layer, an example using an i-line antireflection film 10 will be described below. I-line will be described in detail below, and i-line in this case is light at least centering on a wavelength of 365 nm.

A material used for forming the i-line antireflection film 10 is desired to be capable of sufficiently absorbing i-line, and exercising its absorption characteristic at a film thickness which can be easily dissolved and removed. Further, a part of the i-line antireflection film 10 is used as a mask when the first layer 9 is subjected to patterning in a later process. Therefore, it is desirable that the i-line antireflection film 10 can absorb the light within the photosensitive wavelength range of the first layer 9, and more desirable that the film can absorb the light enough as not to transmit it.

For example, a material produced by cross-linking following (A) and following (B) can be used.

(A) A polymer or a copolymer produced by using an ester of a hydroxy compound and acrylic acid or methacrylic acid, as apart of a monomer. The hydroxy compound is selected from bisphenylsulfones and benzophenones which include a hydroxyl.

(B) A resist acquired by cross-linking using a cross-linking agent selected from a nitrogen-containing compound that includes at least two amino groups which are replaced with a hydroxyalkyl group, an alkoxyalkyl group, or the both of them.

The polymer or copolymer (A) can be shown in a following formula (1), for example.

(1)

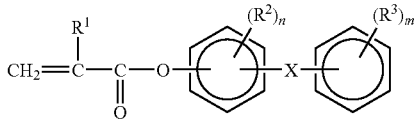

In the formula (1), R1 indicates a hydrogen atom or a methyl group, and X indicates —SO2— or —CO—. R2 and R3 can be the same or different. When there are a plurality of R2 or R3, each R2 and each R3 can be the same or different. R2 and R3 are selected from followings.

That is, a hydrogen atom, a hydroxyl group, an alkyl group, an alkoxy group, a halogen atom, an amino group, a lower dialkylamino group, a carboxyl group, a tert-butoxy group, a tert-butoxycarbonyloxy group, a lower alkoxyalkoxy group, a tetrahydropyranyloxy group, and a tetrahydrofuranyloxy group. However, hydrogen atom is not selected to both R2 and R3 at the same time. Further, in the formula (1), "n" is a natural number equal to or smaller than 4, and "m" is a natural number equal to or smaller than 5.

As for a commercial product used for the i-line antireflection film 10, SWK-T7 LE manufactured by TOKYO OHKA KOGYO Co., Ltd. can be used.

The i-line antireflection film 10 is formed by a coating method, such as a spin coating method, a roll coating method, or a slit coating method, to have a thickness of 0.3 μm to 1.0 μm.

Figure 3C:
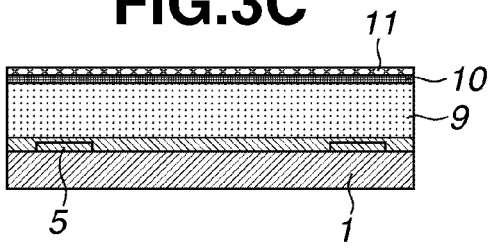

Then, as illustrated in FIG. 3C, a photo-resist 11 is formed on the i-line antireflection film 10 on the first layer 9. The photo-resist 11 serves as a resist mask for patterning the i-line antireflection film 10. A positive resist containing a naphthoquinone diazide compound and a novolak resin is suitable for a material of the photo-resist 11 formed on the material layer for forming the second layer 10*a*.

By considering a selection ratio of the i-line antireflection film 10 at a time of dry etching in a later process and an usage of the photo-resist 11 as a mask material of the first layer 9, the photo-resist 11 is formed by a coating method, such as a spin coating method, a roll coating method, or a slit coating method, to have a thickness of 0.3 μm to 2.0 μm which is equal to or thicker than a thickness of the i-line antireflection film 10.

Figure 3D:
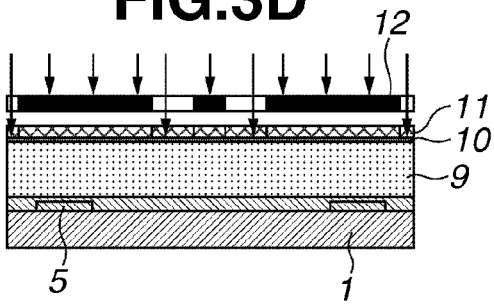

As illustrated in FIG. 3D, the photo-resist 11 is exposed with light using a mask 12. The most generally used i-line (365 nm) is used for the exposure.

Figure 3E:
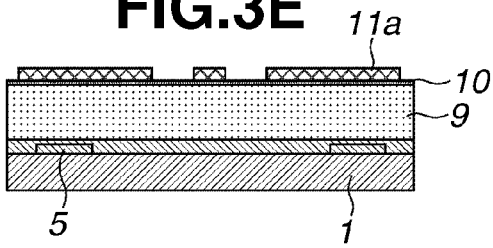

As illustrated in FIG. 3E, the photo-resist layer 11 is developed with a predetermined etching liquid, so that a resist pattern layer 11*a* which has a shape corresponding to the shape of the flow path is formed.

Figure 3F:
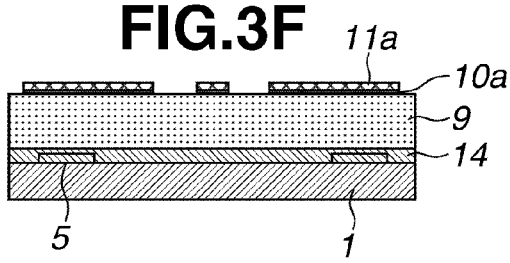

As illustrated in FIG. 3F, the i-line antireflection film 10 is subjected to dry-etching using the resist pattern layer 11*a* as a mask, and then the second layer 10*a* which has a shape corresponding to the shape of the flow path is formed. The second layer 10*a* approximately matches a plane shape of the flow path when the flow path is seen from the discharge port side toward the substrate side. An error occurring in a photolithographic process may be considered, and the second layer 10*a* needs not to completely match the plane shape of the flow path.

Figure 3G:
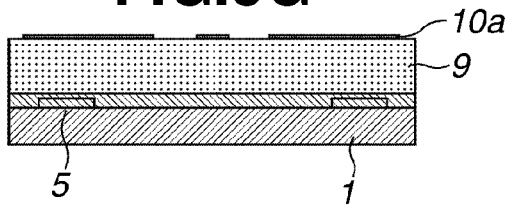

Then, as illustrated in FIG. 3G, the resist pattern layer 11*a* is removed.

Figure 3H:
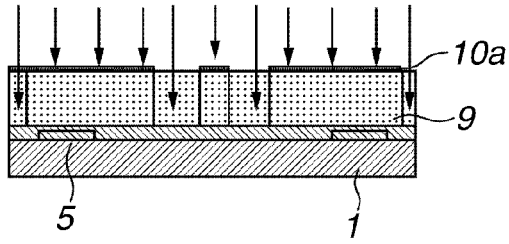

Further, as illustrated in FIG. 3H, the first layer 9 is entirely exposed with light using the second layer 10 as a mask.

Figure 3I:
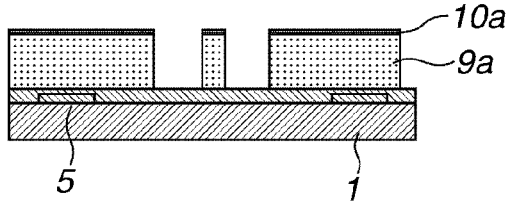

Furthermore, as illustrated in FIG. 3I, the first layer 9 is developed with a predetermined etching liquid, and then is formed into a pattern 9*a* (a flow path pattern) which has the shape of the flow path to be formed later.

Although the surface of the first layer 9 is entirely exposed with deep ultra violet light (Deep-UV light), pattern perpendicularity can be protected from blunting due to a diffraction light at a time of proximity exposure by using the second layer 10*a* as a mask. Further, since the photosensitive resin is exposed providing a contact mask, an alignment error occurring due to the heat expansion difference between the substrate and the photosensitive resin can be reduced when the resist is subjected to patterning.

Figure 4:
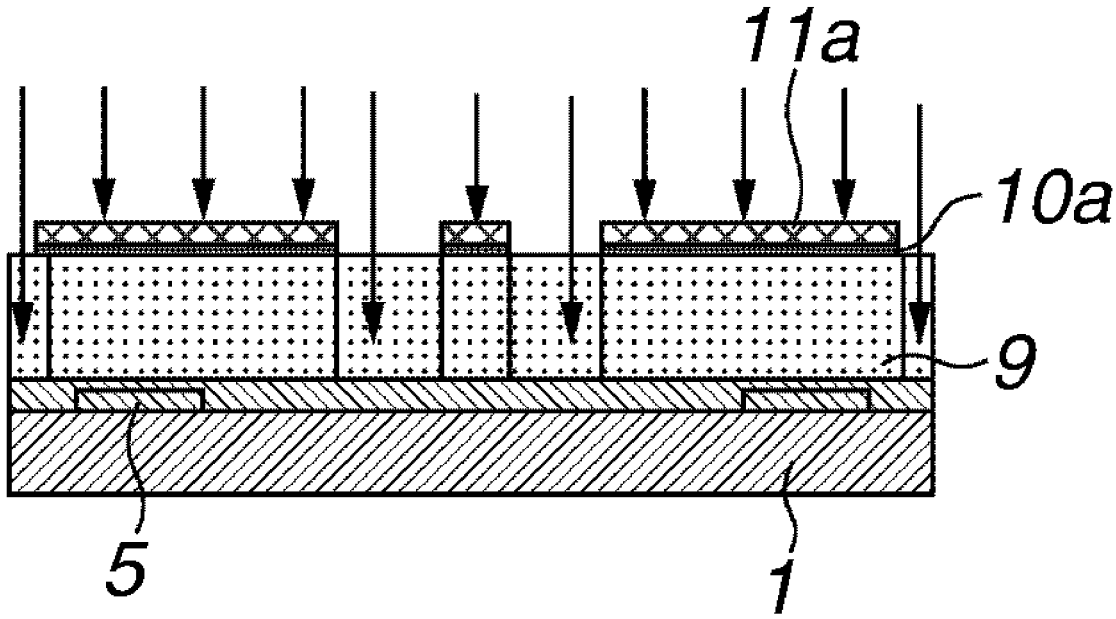
FIG. 4 is a schematic cross-sectional view illustrating an example of a method for manufacturing a liquid discharge head according to the exemplary embodiment of the present invention.

As illustrated in FIG. 4, the first layer 9 can be exposed in a state that the resist pattern layer 11*a* is provided on the second layer 10*a*. When the resist pattern layer 11*a* is on the second layer 10*a*, the resist pattern layer 11*a* can block light to the first layer 9 if the resist pattern layer 11*a* can reflect or absorb light with which the first layer 9 is exposed. Then the flow path pattern 9*a* is formed, and the resist pattern layer 11*a* is removed, so that the state illustrated in FIG. 3I can be acquired.

Figure 5A:
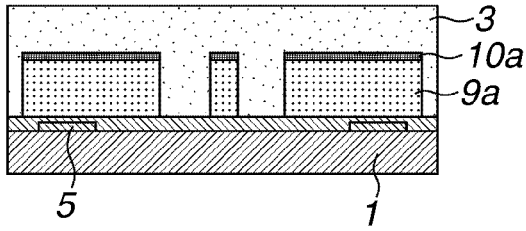
FIGS. 5A to 5E are schematic cross-sectional views illustrating an example of a method for manufacturing a liquid discharge head according to the exemplary embodiment of the present invention.

As illustrated in FIG. 5A, a cover layer 3 made of a photosensitive resin to be a flow path wall member is formed so as to cover the flow path pattern 9*a* and the second layer 10*a*. The cover layer 3 is formed by a coating method, such as a spin coating method, a roll coating method, or a slit coating method, to have a thickness of 10 μm to 30 μm. A resin used for the cover layer 3 is a photosensitive resin, and excellent patterning accuracy and an excellent shape can be acquired by using an epoxy resin.

Figure 5E:
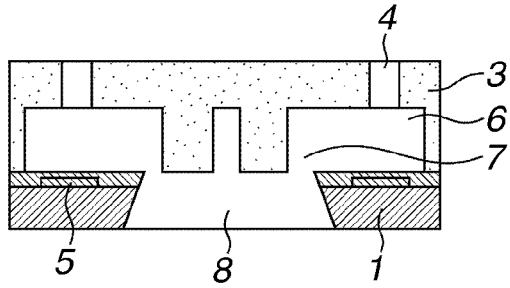
Figure 5B:
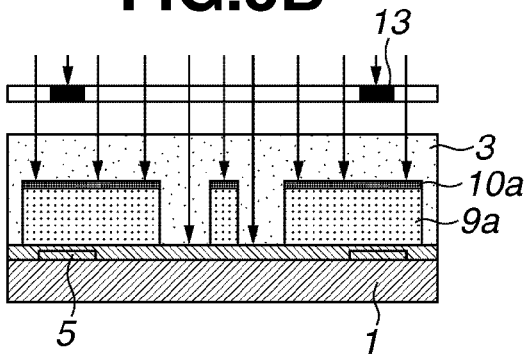
Figure 5C:
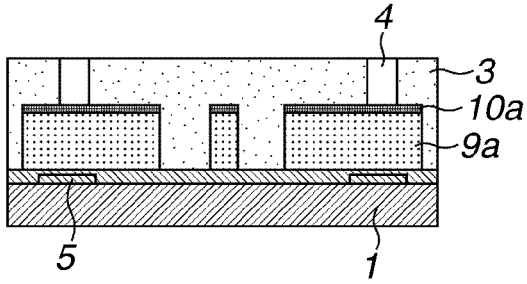

As illustrated in FIG. 5B, the cover layer 3 is exposed with light to form a predetermined pattern. At this time, the cover layer 3 is exposed with i-line (365 nm) using a mask 13, and then is developed with a predetermined etching liquid. Thus, the discharge port 4 is formed as illustrated in FIG. 5C.

I-line is the light which has a center wavelength of 365 nm and a full width at half maximum of about 5 nm. When a normal i-line exposure apparatus is used, the apparatus cuts light of a wavelength except i-line among light exposed from a mercury-vapor lump, and irradiates an object with the i-line.

When the cover layer 3 is irradiated with i-line to form the discharge port 4, the second layer 10*a* absorbs i-line and can suppress deformation of the discharge port 4. Since the light transmitting the cover layer 3 is directly irradiated on the second layer 10*a*, and the second layer 10*a* absorbs the light transmitting the cover layer 3 and reflecting at the surface of the substrate 1, i-line reflecting on the surface of the substrate 1 is prevented from being irradiated on the cover layer 3.

Figure 5D:
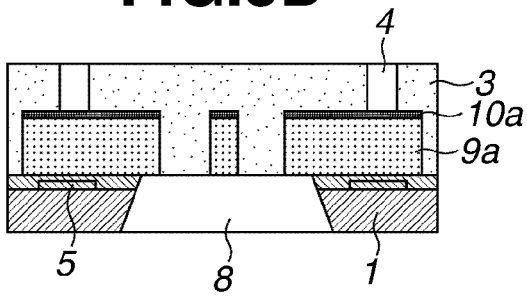

As illustrated in FIG. 5D, the substrate 1 is dipped in an alkaline etching liquid from a back surface, and etching is performed to form the supply port 8.

As illustrated in FIG. 5E, the pattern layer 9*a* and the second layer 10*a* are removed from the discharge port 4 and the supply port 8 by using an appropriate etching liquid, and the flow path 7 and a chamber 6 are thus formed. The chamber 6 is a part of the flow path 7, and corresponds to a discharge energy generating region by the energy generating elements.

An exemplary embodiment of the present invention will be described in detail below.

Referring to FIG. 3A, a polymethyl isopropenyl ketone layer 9 (ODUR, manufactured by TOKYO OHKA KOGYO Co., Ltd.) is formed as the first layer 9 on a silicon wafer in which the heater 5 and the membranous layer 14 for protecting the heater 5 are formed on the surface of the substrate 1. The polymethyl isopropenyl ketone layer 9 is formed by a spin coating method to have a thickness of 13.5 μm.

Then, in FIG. 3B, an i-line absorption film (SWK-T7 LE, manufactured by TOKYO OHKA KOGYO Co., Ltd.) is formed as the i-line antireflection film 10 on the first layer 9 by the spin coating method to have a thickness of 0.5 μm. It is known that a layer which is made of SWK-T7 LE and has a thickness of equal to or greater than 0.3 μm can nearly completely block i-line.

In FIG. 3C, a positive resist which contains a naphthoquinone diazide compound and a novolak resin (OFPR-800, manufactured by TOKYO OHKA KOGYO Co., Ltd.) is formed as the photo-resist 11 on the i-line absorption film 10. The positive resist is formed by the spin coating method to have thickness of 1.0 μm.

In FIG. 3D, exposure of the photo-resist layer 11 is performed using the mask 12 at 100 mJ/m$^2$. The exposure is performed using an i-line stepper (manufactured by Canon Inc.).

In FIG. 3E, the photo-resist layer 11 is developed with a liquid mainly including a tetramethylammonium hydroxide solution, and the resist pattern layer 11*a* which has a shape corresponding to the shape of the flow path is formed.

In FIG. 3F, dry-etching of the i-line antireflection film 10 is performed using the resist pattern layer 11*a* as a mask, and the second layer 10*a* which has a shape corresponding to the shape of the flow path, as similar to that of the photo-resist layer 11*a*. Dry-etching is performed by an etching apparatus (NLD-6000, manufactured by ULVAC, Inc.) using carbon tetrafluoride ($CF_4$) and oxygen ($O_2$).

In FIG. 4, exposure of the entire surface of the first layer 9 is performed at 23 J/cm$^2$, using the resist pattern layer 11*a* and the second layer 10*a* as masks.

In FIG. 3I, the resist pattern layer 11*a* and exposed portions of the first layer 9 are collectively removed, and a flow path pattern 9*a* provided with the second layer 10*a* is formed.

In FIG. 5A, the cover layer 3 made of a negative photosensitive resin (which has composition described below) is formed so as to cover the second layer 10*a* and the flow path pattern 9*a*. The cover layer 3 is formed by the spin coating method to have a thickness of 11 μm.

Composition

Epoxy resin: EHPE-3150 (manufactured by DAICEL CHEMICAL INDUSTRIES, LTD) 53% by weight Cationic photopolymerization initiator: SP-172 (manufactured by Adeka Corporation) 3% by weight Methyl isobutyl ketone 44% by weight In FIG. 5B, the cover layer 3 is exposed with the light to form a predetermined pattern. At this time, the mask 13 was used, and exposure is performed at 4000 J/m$^2$, using an i-line stepper (EPA3000i5+, manufactured by Canon Inc.). Then the cover layer 3 is developed with methyl isobutyl ketone, and the discharge port 4 having a diameter of ϕ9 to ϕ16 is formed.

In FIG. 5D, the substrate 1 is dipped in an alkaline etching liquid, such as tetra methyl ammonium hydroxide, from the back surface of the substrate 1. Thus the supply port 8 is formed by etching.

In FIG. 5E, the flow path pattern 9*a* and the second layer 10*a* are removed from the discharge port 4 and the supply port 8, so that the flow path 7 including the chamber portion 6 is formed.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-060683 filed Mar. 13, 2009, which is hereby incorporated by reference herein in its entirety.

What is claimed is:

1. A method for manufacturing a liquid discharge head that includes a flow path wall member which forms a wall of a flow path communicating with a discharge port for discharging a liquid and a substrate which forms the flow path in contact with the flow path wall member, the method comprising:

providing a first layer, which is made of a photosensitive resin on the substrate, for forming a pattern having a shape of the flow path;

providing a second layer which is capable of absorbing light within a photosensitive wavelength range of the photosensitive resin and has a shape corresponding to the shape of the flow path, on the first layer so as to come into contact with the first layer;

performing patterning of the first layer which includes exposure of the first layer with the light using the second layer as a mask, and forming the pattern from the first layer;

providing a cover layer which is made of a photosensitive resin and serves as the flow path wall member so as to cover the second layer and the pattern;

forming the discharge port on the cover layer by performing patterning of the cover layer which includes exposure of the cover layer with the light; and forming the flow path by removing the second layer and the pattern.

2. The method according to claim 1, wherein providing the second layer on the first layer comprises, providing a material layer that becomes the second layer on the first layer, providing a resist pattern layer which has a shape corresponding to the pattern on the material layer, and etching the material layer using the resist pattern layer as a mask to make the second layer from the material layer, wherein the first layer is exposed in a state that the resist pattern layer is provided on the second layer.

3. The method according to claim 2, further comprising collectively removing the resist pattern layer and exposed portions of the first layer after exposing the first layer in a state that the resist pattern layer is provided on the second layer.

4. The method according to claim 2, further comprising providing a cover layer made of a photosensitive resin that becomes the flow path wall member on the substrate to cover the second layer and the pattern, after exposing the first layer in a state that the resist pattern layer is provided on the second layer and removing the resist layer.

5. The method according to claim 1, wherein the cover layer is made of a negative photosensitive resin.

6. The method according to claim 1, wherein the first layer is made of a positive photosensitive layer.

7. The method according to claim 1, wherein the cover layer is exposed with i-line.

* * * * *